US011638884B1

(12) United States Patent
Zhang

(10) Patent No.: US 11,638,884 B1
(45) Date of Patent: May 2, 2023

(54) BASIC CONNECTING BLOCK AND CONNECTING BLOCK GROUP

(71) Applicant: Zhejiang Benlai Household Technology Co., Ltd., Huzhou (CN)

(72) Inventor: Fei Zhang, Zhejiang (CN)

(73) Assignee: Zhejiang Benlai Household Technology Co., Ltd., Huzhou (CN)

( * ) Notice: Subject to any disclaimer, the term of this patent is extended or adjusted under 35 U.S.C. 154(b) by 0 days.

(21) Appl. No.: 17/512,761

(22) Filed: Oct. 28, 2021

(51) Int. Cl.
*A63H 33/08* (2006.01)
*A63H 33/10* (2006.01)

(52) U.S. Cl.
CPC ..... *A63H 33/084* (2013.01); *A63H 33/086* (2013.01); *A63H 33/105* (2013.01)

(58) Field of Classification Search
CPC ..... A63H 33/08–084; A63H 33/105; A63H 33/086; E04B 1/02–04; E04B 2/08
USPC ..... 52/574; D21/484; 446/117, 69; 206/509
See application file for complete search history.

(56) References Cited

U.S. PATENT DOCUMENTS 141,089 A * 7/1873 Spencer ..... A63H 3/52 446/257
903,906 A * 11/1908 Soss ..... E04B 2/18 D25/113
1,026,112 A * 5/1912 O'Brien ..... A63H 3/52 446/257
1,660,119 A * 2/1928 Decker ..... A47C 13/00 446/482
1,660,459 A * 2/1928 Thomson ..... E01C 5/06 52/574
1,689,107 A * 10/1928 Bradley ..... E04B 2/08 D25/113
1,997,022 A * 4/1935 Stalker ..... A63F 9/088 D11/89
2,151,066 A * 3/1939 Anderson ..... G09B 23/04 229/116
D124,755 S * 1/1941 Voorhis ..... 206/509
2,440,836 A * 5/1948 Turngren ..... A63H 33/04 446/124
2,496,093 A * 1/1950 Iwata ..... B65D 21/0223 206/509
2,549,189 A * 4/1951 Gabo ..... E04C 2/32 428/116
2,923,551 A * 2/1960 Pope ..... A63H 33/082 273/157 R
2,936,544 A * 5/1960 Kohner ..... A63H 33/084 446/124
3,346,998 A * 10/1967 Nelson ..... E04B 1/32 D25/4

(Continued)

*Primary Examiner* — Eugene L Kim
*Assistant Examiner* — Matthew B Stanczak

(57) ABSTRACT

The application relates to a field of object connection and in particular, relates to a basic connecting block and a connecting block group. The basic connecting block includes a connecting block body, wherein at least one protrusion corner is provided on one side of the connecting block body and same number of inward recesses as the protrusion corner are provided on an opposite side of the connecting block body, and wherein a surface contour of the protrusion corner is consistent with that of the inward recess, the protrusion corners are connected with each other and the inward recesses are communicated with each other.

9 Claims, 8 Drawing Sheets

(56) References Cited

U.S. PATENT DOCUMENTS 3,435,576 A * 4/1969 Giannelia ..... E04B 2/12 D25/113
3,461,574 A * 8/1969 Larsen ..... A63F 9/06 273/156
3,462,062 A * 8/1969 Miller ..... B65D 5/001 52/592.1
3,508,367 A * 4/1970 Niebylski ..... E04B 2/12 52/316
3,568,381 A * 3/1971 Hale ..... E04B 1/32 52/DIG. 10
3,645,059 A * 2/1972 Grimm ..... E06B 9/01 446/124
3,708,910 A * 1/1973 Skillman ..... A63H 33/088 446/117
3,783,571 A * 1/1974 Horvath ..... E04B 2/12 52/592.1
3,787,996 A * 1/1974 Smith ..... A63H 33/04 446/124
3,822,569 A * 7/1974 Lautrup-Larsen ..... A63H 33/04 446/85
3,834,067 A * 9/1974 Koleczek ..... A63H 33/084 446/124
3,834,108 A * 9/1974 Ludvigsen ..... E04B 2/12 52/592.6
3,950,888 A * 4/1976 Hogan ..... A63H 33/108 446/124
3,999,327 A * 12/1976 Immordino ..... B65D 81/361 206/509
4,008,932 A * 2/1977 Wildschut ..... A47B 87/0253 312/198
4,034,533 A * 7/1977 Faas ..... E04B 2/06 52/631
4,040,226 A * 8/1977 Fernaeus ..... B28B 7/183 52/592.6
4,041,660 A * 8/1977 Yensen ..... E04B 2/22 D25/113
4,115,963 A * 9/1978 Lubov ..... E04B 1/32 52/81.4
4,121,831 A * 10/1978 Greene ..... A63F 9/12 446/124
4,310,994 A * 1/1982 Gephardt ..... E04B 2/12 52/608
4,441,298 A * 4/1984 Limousin ..... A63H 33/088 52/592.2
4,502,257 A * 3/1985 Diamond ..... E04C 2/328 52/80.1
4,537,001 A * 8/1985 Uppstrom ..... B44C 3/123 D25/138
4,633,639 A * 1/1987 Deimen ..... A63H 33/084 446/124
4,651,485 A * 3/1987 Osborne ..... E04B 2/08 52/592.1
4,711,599 A * 12/1987 Glickman ..... E01C 5/00 D25/113
4,719,726 A * 1/1988 Bergman ..... E04B 1/3211 52/81.4
4,778,392 A * 10/1988 Mitchell ..... G09B 1/00 229/113
4,983,137 A * 1/1991 Carpenter ..... A63F 9/0669 446/85
4,990,116 A * 2/1991 Chen ..... A63H 33/084 446/124
5,020,287 A * 6/1991 Woods ..... E04B 7/102 52/80.2
5,137,146 A * 8/1992 Stonehouse ..... A45C 11/02 206/509
5,168,677 A * 12/1992 Pronsato ..... A63F 9/1208 52/81.1
5,169,352 A * 12/1992 Petersen ..... G09F 19/00 446/124
5,275,503 A * 1/1994 Lewis ..... E01C 5/00 404/42
D343,908 S * 2/1994 Naether ..... D25/113
5,448,868 A * 9/1995 Lalvani ..... A63B 9/00 52/648.1
6,257,574 B1 * 7/2001 Evans ..... A63F 9/12 273/157 R
6,606,835 B1 * 8/2003 Bilka ..... E04B 2/18 52/315
6,921,314 B2 * 7/2005 Miller ..... A63H 33/084 446/85
D638,501 S * 5/2011 Fishman ..... D21/504
D649,201 S * 11/2011 Fishman ..... D21/504
8,800,236 B2 * 8/2014 Yong ..... E04C 1/00 52/574
8,869,464 B2 * 10/2014 Newland ..... G06F 17/10 52/80.1
9,183,957 B2 * 11/2015 Farrell ..... E04C 1/39
D843,497 S * 3/2019 Howard ..... D21/505
D849,850 S * 5/2019 Holowka ..... D21/484
10,378,223 B2 * 8/2019 Swink ..... E04G 9/10
10,494,810 B1 * 12/2019 Garunts ..... E04B 2/08
10,722,782 B2 * 7/2020 Hung ..... A63F 9/1208
10,731,686 B1 * 8/2020 Granek ..... A63H 33/046
D917,630 S * 4/2021 Chumillas Zurilla ..... D21/505
11,414,861 B2 * 8/2022 Savushkin ..... E04B 2/18
2006/0234600 A1 * 10/2006 Pacheco ..... A63H 33/046 446/124
2012/0302127 A1 * 11/2012 Doskas ..... A63H 33/046 446/92
2013/0115848 A1 * 5/2013 Silverglate ..... A63H 33/006 446/124
2019/0206280 A1 * 7/2019 Palmer ..... A63H 33/046
2020/0215451 A1 * 7/2020 Chiu ..... A63H 33/08

* cited by examiner

BASIC CONNECTING BLOCK AND CONNECTING BLOCK GROUP

TECHNICAL FIELD

The present application relates to a field of object connection, and in particular, relates to a basic connecting block and a connecting block group.

BACKGROUND

There are multiply superposition means of connecting blocks, for example, stacking up connecting blocks together by connectors or by plug connections between columns and holes. However, the upper and lower connecting blocks must be aligned whether they are stacked up by connectors or by plug connections between columns and holes, and the upper and lower connecting blocks cannot be stacked up if they are not aligned. The connecting blocks can also be stacked up relying entirely on the gravity thereof, but the connection between two connecting blocks is very unstable. Once an external force is applied on the connecting blocks, the upper connecting block is very easy to slip off.

SUMMARY

In order to stack up connecting blocks more stably and conveniently, the present application provides a basic connecting block and a connecting block group.

The present application provides a basic connecting block as described below.

In a first aspect, the present application provides a basic connecting block, the technical solution of which will be described below.

A basic connecting block, comprising: a connecting block body, wherein at least one protrusion corner is provided on one side of the connecting block body and same number of inward recesses as the protrusion corner are provided on an opposite side of the connecting block body, and wherein a surface contour of the protrusion corner is consistent with that of the inward recess, the protrusion corners are connected with each other and the inward recesses are communicated with each other.

With the above technical solution, when stacking up the basic connecting blocks, the protrusion corner of the lower basic connecting block is in the inward recess of the upper basic connecting block and the surface of the protrusion corner is abutted to the surface of the inward recess. Due to the same surface contours of the protrusion corner and the inward recess, the upper basic connecting block can be placed on the lower basic connecting block stably.

In an embodiment, a plurality of the protrusion corners are rotationally symmetrically arranged about a central axis of the connecting block body, and a plurality of the inward recesses are rotationally symmetrically arranged about the central axis of the connecting block body.

With the above technical solution, when the protrusion corner of the upper basic connecting block is not aligned to the inward recess of the lower basic connecting block and the upper and lower basic connecting blocks contacts with each other, the upper basic connecting block can be deviated and rotated so that the protrusion corner of the upper basic connecting block is aligned to the inward recess of the lower basic connecting block and finally the upper and lower basic connecting blocks can be abutted and stacked up. The upper and lower basic connecting blocks can be automatically aligned when stacking together, which is convenient and fast.

In an embodiment, a projection of the protrusion corners on the connecting block body completely coincides with a projection of the inward recesses on the connecting block body.

With the above technical solution, because the projection of the protrusion corner and the projection of the inward recess are entirely coincided on the connecting block body, the stacked upper and lower basic connecting blocks can be completely aligned, so that centers of gravity of the stacked basic connecting blocks are on the same line, which makes the basic connecting blocks not easy to overturn and a plurality of the basic connecting blocks can be stacked up to a very large height.

In an embodiment, the protrusion corner is provided with a first arris edge that is located at a position where a distance from the protrusion corner to the connecting block body is farthest, the connecting block body is provided with a second arris edge in the inward recess that is located at a position where a distance from the inward recess to a surface of the connecting block body provided with the inward recess is farthest, and projections of the first arris edge and the second arris edge are intersected on a side of the connecting block body provided with the protrusion corner.

With the above technical solution, because the projections of the first arris edge and the second arris edge are intersected, the basic connecting blocks may be staggered stacked in a certain angle.

In an embodiment, a first transition surface is provided between adjacent protrusion corners, and a second transition surface is provided between adjacent inward recesses.

With the above technical solution, because the upper and lower basic connecting blocks may be rotated and deviated during stacking, the first and second transition surfaces may reduce a friction strength during rotation and deviation, so as to reduce an abrasion.

In an embodiment, an outer plane is provided at a junction of the plurality of protrusion corners, and an inner plane is provided at a junction of the plurality of inward recesses, and wherein shape of the inner plane is the same as the outer plane.

With the above technical solution, the inner plane of the upper basic connecting block can be abutted to the outer plane of the lower basic connecting block when stacking up the upper and lower basic connecting blocks. Compared to the point contact, the stacked upper and lower basic connecting blocks can be placed more stably by the plane contacting of the internal and outer planes, so that the basic connecting block is not easy to slide when it is pushed from the side.

In an embodiment, the basic connecting block comprises a plurality of the connecting block bodies that are fixedly connected with each other, and side surfaces of the connecting blocks bodies provided with protrusion corners are coplanar.

With the above technical solution, the basic connecting block with multiply connecting block bodies is placed at the bottom so as to improve the stability of the whole structure when stacking up the basic connecting blocks.

In an embodiment, the plurality of connecting block bodies have the same volume and different densities.

With the above technical solution, by setting different densities of the interconnected connecting block bodies may change the center of the gravity of the basic connecting block, so that the whole structure is more stable and not easy to slide when stacking up basic connecting blocks.

In an embodiment, the basic connecting block is used as a block toy.

With the above technical solution, when the basic connecting blocks are as block toys, multiple basic connecting blocks can be stacked up in different shapes and heights, which improves the interestingness of toys.

In an embodiment, the basic connecting block is applied in an architecture field.

With the above technical solution, when stacking up the basic connecting blocks, adhesives can be applied between the basic connecting blocks to form a simple wall.

In a second aspect, the present application provides a connecting block group, the technical solution of which will be described below.

A connecting block group includes the above mentioned basic connecting block and an expansion connecting block, wherein the expansion connecting block is provided with at least one expansion protrusion corner on each of two opposite sides thereof, and the expansion protrusion corners are interconnected with each other.

In the above technical solution, as a block toy, the expansion connecting block can be used together with the basic connecting block to improve the interestingness.

In a third aspect, the present application provides a connecting block group, the technical solution of which will be described below.

A connecting block group includes the above mentioned basic connecting block and an expansion connecting block, wherein the expansion connecting block is provided with at least one expansion inward recess on each of two opposite sides thereof, and the expansion inward recesses are communicated with each other.

In the above technical solution, as a block toy, the expansion connecting block can be used together with the basic connecting block to improve the interestingness.

In summary, the present application can bring at least one of the following beneficial technical effects:

1. the protrusion corner and the inward recess are provided with same contours, so that the upper basic connecting block can be stably placed on the lower basic connecting block;
2. the protrusion corners are rotationally symmetrically arranged about the central axis of the connecting block body, so that the upper and lower basic connecting blocks can be automatically aligned when stacking together, which is convenient and fast;
3. a projection of the protrusion corner and a projection of the inward recess are entirely coincided on the connecting block body, so that centers of gravity of the stacked basic connecting blocks are on the same line, which makes the basic connecting block not easy to overturn and a plurality of the basic connecting blocks can be stacked up to a very large height; and
4. the projections of the first arris edge and the second arris edge are intersected, so that the basic connecting blocks may be staggered stacked in a certain angle.

DETAILED DESCRIPTION OF THE INVENTION

The present application will be described in detail below with reference to FIGS. 1-15.

A basic connecting block is provided according to embodiments of the present application.

A plurality of basic connecting blocks according to the present application may be applied to block toys that can stack up structures with different shapes and heights, so as to enhance the interestingness of block toys. The basic connecting blocks according to the present application may also be applied to bricks for construction that can build temporary walls. The basic connecting block can be made of different materials according to different use scenarios. For example, the basic connecting blocks as block toys may be made of wood or plastic, while the basic connecting blocks as bricks may be made of metal or cement.

Embodiment 1

Figure 1:
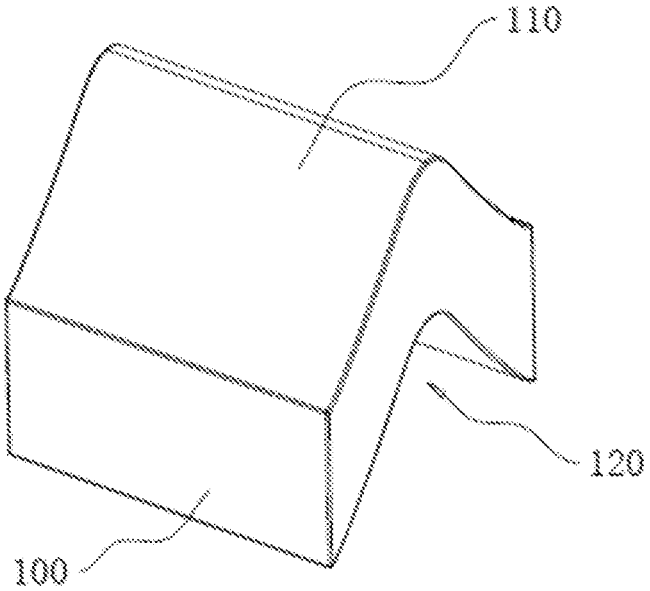
FIG. 1 is a schematic structure diagram of a basic connecting block according to an embodiment 1 of the present application.

Referring to FIG. 1, a basic connecting block includes a connecting block body 100, which may be a cube or a cuboid. The connecting block body 100 is provided with a protrusion corner 110 on one side thereof, and an inward recess 120 on another side thereof. The protrusion corner 110 and the inward recess 120 are arranged on two opposite sides of the connecting block body 100 respectively, and a surface contour of the protrusion corner 110 is coincident with that of the inward recess 120. The contour of the protrusion corner 110 may be circular arch, triangle, rectangle, polygon shape and so on. In this embodiment, the contour of the protrusion corner 110 is circular arch. The connecting block body 100 is integrally formed with the protrusion corner 110.

Figure 2:
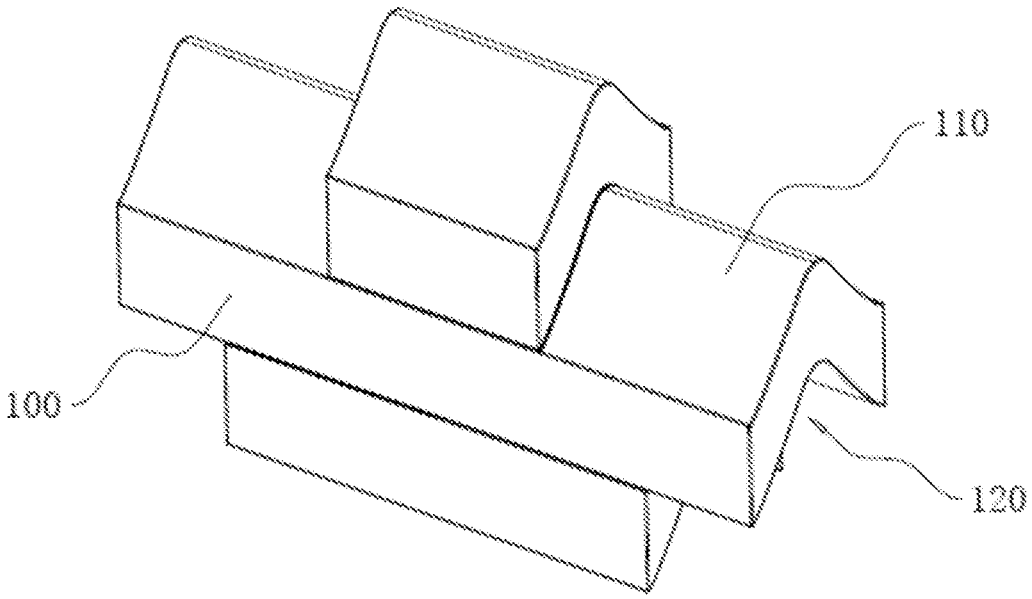
FIG. 2 is a schematic structure diagram of the stacked basic connecting blocks according to the embodiment 1 of the present application.

The implementation principle of embodiment 1 will be described below. When a plurality of basic connecting blocks are stacked up, a protrusion corner 110 of connecting block body 100 fits with an inward recess 120 of an adjacent connecting block body 100 in the up-and-down direction. When the upper and lower adjacent basic connecting blocks are abutted and stacked up, the protrusion corner 110 of the lower basic connecting block is placed in the inward recess 120 of the upper basic connecting block, and the surface of the protrusion corner 110 is fitted in with the surface of the inward recess 120, so that the upper basic connecting block can be stably placed on the lower basic connecting block. Referring to FIG. 2, basic connecting blocks with different lengths can also be stacked up.

Embodiment 2

Figure 3:
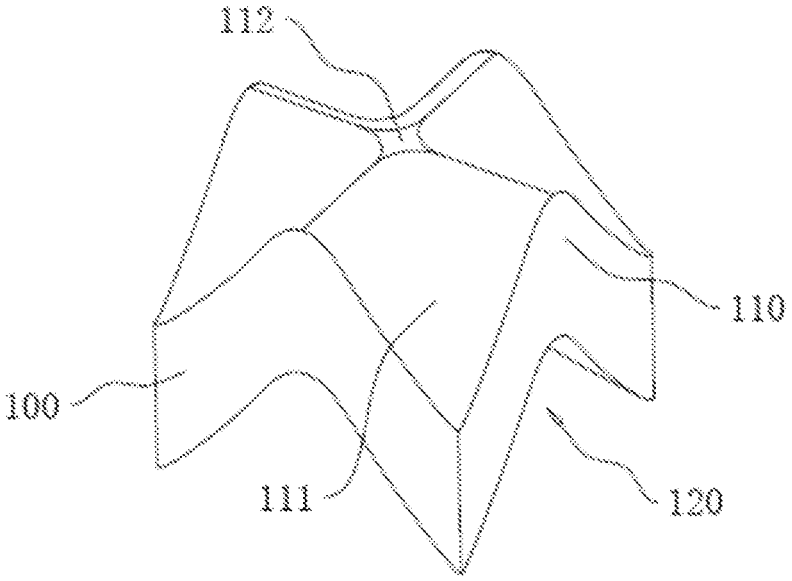
FIG. 3 is a schematic structure diagram of a basic connecting block according to an embodiment 2 of the present application, which illustrates a structure of a protrusion corner.
Figure 4:
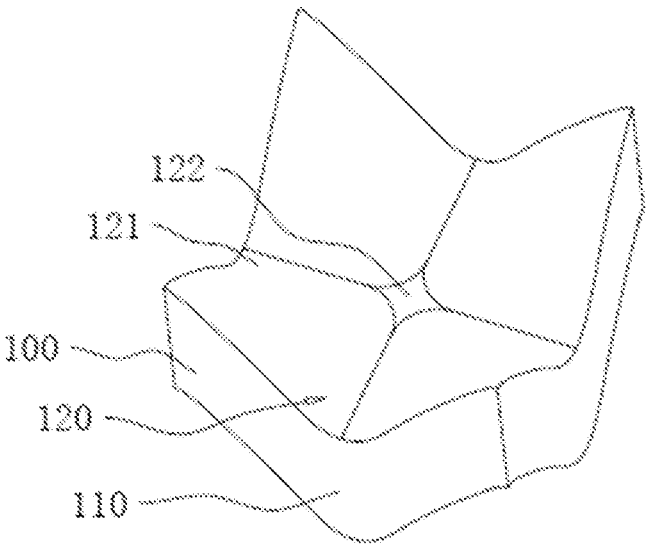
FIG. 4 is a schematic structure diagram of the basic connecting block according to an embodiment 2 of the present application, which illustrates a structure of an inward recess.

Referring to FIGS. 3 and 4, a basic connecting block includes a connecting block body 100 with an equal length and width. That is, the connecting block body 100 is square in the top view. The connecting block body 100 is provided with four protrusion corners 110 on one side thereof and four inward recesses 120 on another side thereof, which one-to-one correspond to the protrusion corners 110. The protrusion corners 110 and the inward recesses 120 are provided on two opposite sides of the connecting block body 100 respectively, i.e., the upper and lower surfaces in FIG. 3. The surface contours of the protrusion corners 110 are coincident with those of the inward recesses 120. The four protrusion corners 110 are rotationally symmetrically arranged about the central axis of the connecting block body 100, and the four inward recesses 120 are rotationally symmetrically arranged about the central axis of the connecting block body 100 as well. A projection of a protrusion corner 110 on the connecting block body 100 completely coincides with a projection of a corresponding inward recess 120 on the connecting block body 100.

Referring to FIGS. 3 and 4, the four protrusion corners 110 are connected with each other, and a smooth first transition surface 111 is provided between adjacent protrusion corners 110. The four inward recesses 120 are communicated with each other, and a smooth second transition surface 121 is provided between adjacent inward recesses 120. The outer contour of the protrusion corner 110 is sinusoidal in the side view, and the first transition surface 111 and the second transition surface 121 are arc-shaped surfaces. The first transition surface 111 is bent toward one side close to the central axis of the connecting block body 100, and the second transition surface 121 is bent toward one side away from the central axis of the connecting block body 100. An outer plane 112 is provided at the junction of the four protrusion corners 110 and an inner plane 122 is provided at the junction of the four inward recesses 120, in which the shapes of the inner plane 122 and the outer plane 112 are the same.

The implementation principle of the embodiment 2 will be described below. A plurality of basic connecting blocks can be stacked up. When a protrusion corner 110 of an upper basic connecting block is completely aligned to an inward recess 120 of a lower basic connecting block, the upper and lower basic connecting blocks are engaged with each other and stacked up. With being stacked up, the second transition surface 121 of the upper basic connecting block is abutted to the first transition surface 111 of the lower basic connecting block, and the inner plane 122 of the upper basic connecting block is abutted to the outer plane 112 of the lower basic connecting block.

If the protrusion corner 110 of the upper basic connecting block is not aligned to the inward recess 120 of the lower basic connecting block, during a falling process of the upper basic connecting block, upon the upper and lower basic connecting blocks contact with each other, the upper basic connecting block may be deviated and rotated, so that the central axes of the two basic connecting blocks are on a line and the protrusion corner 110 of the upper basic connecting block is aligned to the inward recess 120 of the lower basic connecting block. Finally, the upper and lower basic blocks can be abutted and stacked up. The upper and lower basic connecting blocks can be automatically aligned when they are stacked together, which is convenient and fast.

In addition, when the upper and lower basic connecting blocks are stacked up, the upper basic connecting block is equivalent to four weights that are arranged at four corners rotationally symmetrically about the central axis of the connecting block body 100. The four weights have a tendency to pull down the upper basic connecting block. With such design, four vertical tensile forces are evenly applied at an equal distance on a contacting surface of the outer plane 112 and the inner plane 122, so as to reduce shaking between the upper and lower basic connecting blocks.

The basic connecting block according to this embodiment can be applied in the architecture field. In stacking up of multiple basic connecting blocks, the basic connecting blocks can be directly coated with adhesives, so as to quickly pile up simple walls, and the walls are not easy to collapse.

Embodiment 3

Figure 5:
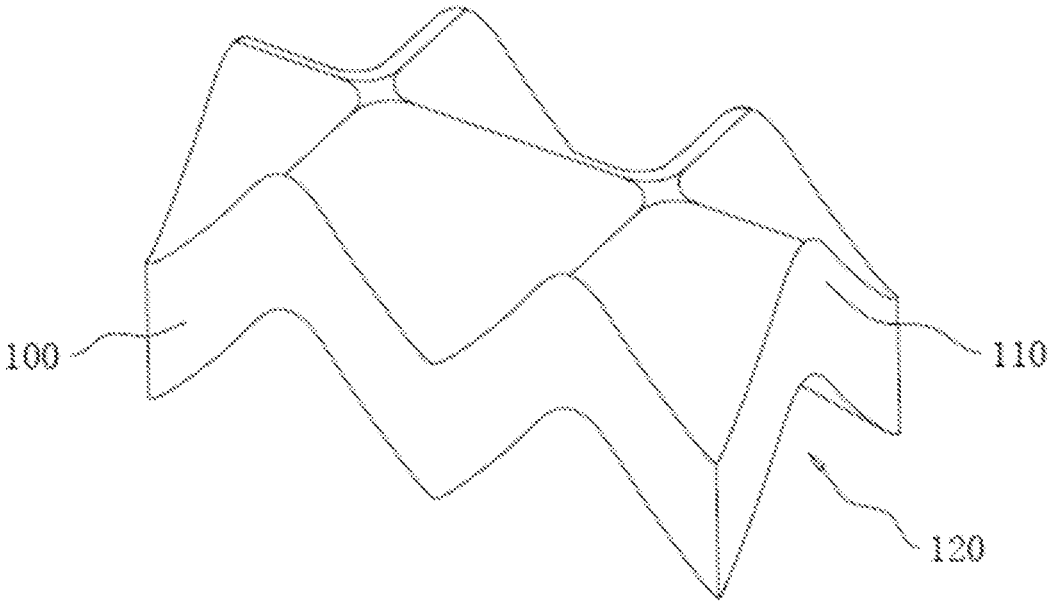
FIG. 5 is a schematic structure diagram of a basic connecting block according to embodiments 3 and 5 of the present application.

Referring to FIG. 5, this embodiment differs from the embodiment 2 in that, the basic connecting block includes a plurality of connecting block bodies 100. In this embodiment, there are two connecting block bodies 100, which are integrally formed. The surfaces of two connecting block bodies 100 provided with protrusion corners 110 are coplanar.

Embodiment 4

Figure 6:
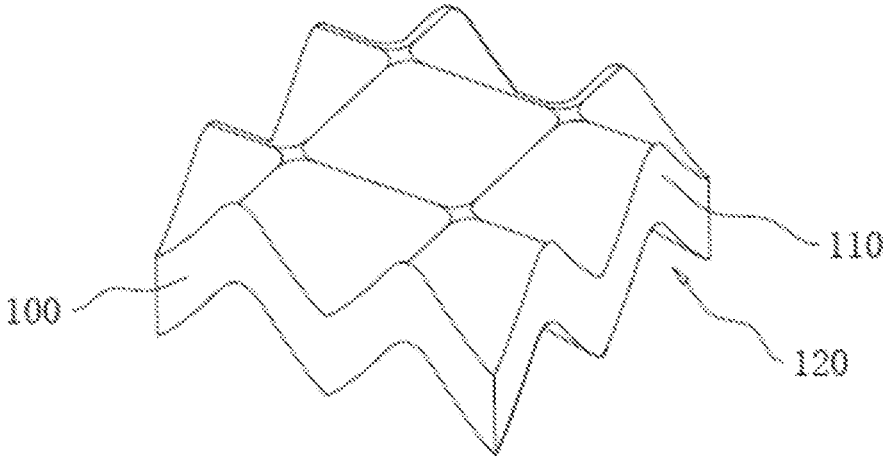
FIG. 6 is a schematic structure diagram of a basic connecting block according to an embodiment 4 of the present application.

Referring to FIG. 6, this embodiment differs from the embodiment 2 in that, the basic connecting block includes a plurality of connecting block bodies 100. In this embodiment, there are four connecting block bodies 100, which are arranged in array distribution. Surfaces of the four connecting block bodies 100 provided with protrusion corners 110 are coplanar.

Embodiment 5

Referring to FIG. 5, this embodiment differs from the embodiment 2 in that, two connecting block bodies 100 have the same volume but have different densities, in which the density of one connecting block body 100 is larger than that of the other one. In this embodiment, the mass of the connecting block body 100 with a larger density is twice the mass of the connecting block body 100 with a smaller density. The connecting block body 100 can be made of polymer materials. The two connecting block bodies 100 with different densities can be integrally form by continuous foaming technology.

Figure 7:
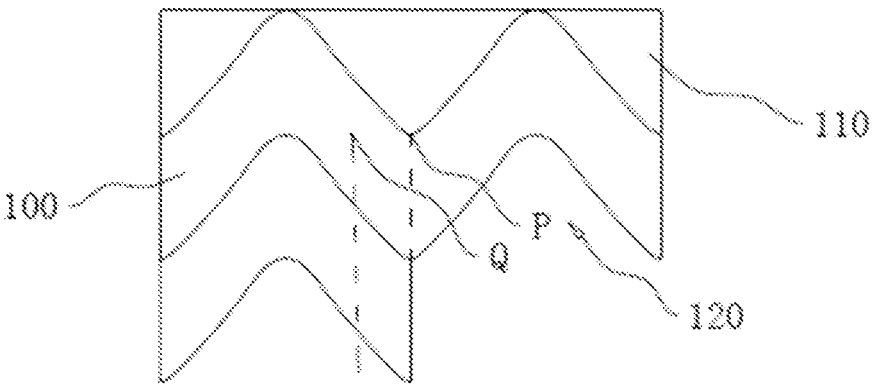
FIG. 7 is a schematic structure diagram of the stacked basic connecting blocks according to embodiments 2 and 5 of the present application.

Referring to FIG. 7, when stacking and connecting with a basic connecting block according to the embodiment 2, if the densities of two connecting block bodies 100 are the same, the center of gravity of the upper basic connecting block is at the P point in the Figure. In this case, the upper basic connecting block is easy to overturn. Therefore, two connecting block bodies are configured with different densities. In this embodiment, the center of gravity of the upper basic connecting block is at the Q point in the Figure, such that the basic connecting blocks according to this embodiment can be more stably connected with each other and are not easy to overturn.

Embodiment 6

Figure 8:
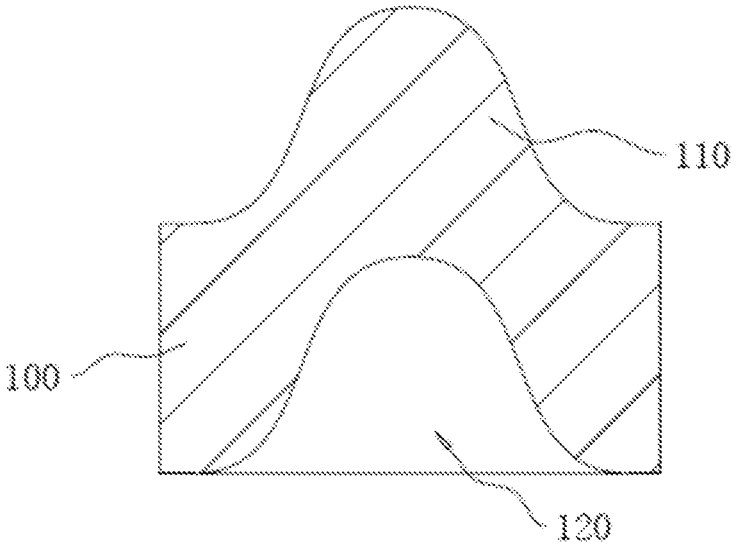
FIG. 8 is a structure sectional view of a basic connecting block according to an embodiment 6 of the present application.

Referring to FIG. 8, a basic connecting block includes a connecting block body 100, which is cylindrical. The connecting block body 100 is provided with a protrusion corner 110 on one end thereof and an inward recess 120 on another end thereof. The surface contour of the protrusion corner 110 is coincident with the surface contour of the inward recess 120. The protrusion corner 110 is circular arch. A projection of the protrusion corner 110 on the connecting block body 100 completely coincides with a projection of the inward recess 120 on the connecting block body 100.

When connecting a plurality of basic connecting blocks, a protrusion corner 110 of a connecting block body 100 is placed correspondingly in an inward recess 120 of an adjacent connecting block body 100 in the up-and-down direction. When the upper and lower adjacent basic connecting blocks are abutted and stacked up, the protrusion corner 110 of the lower basic connecting block is placed in the inward recess 120 of the upper basic connecting block, so that the upper basic connecting block can be stably placed on the lower basic connecting block and the upper basic connecting block can freely rotate around the center axis thereof.

Embodiment 7

Figure 9:
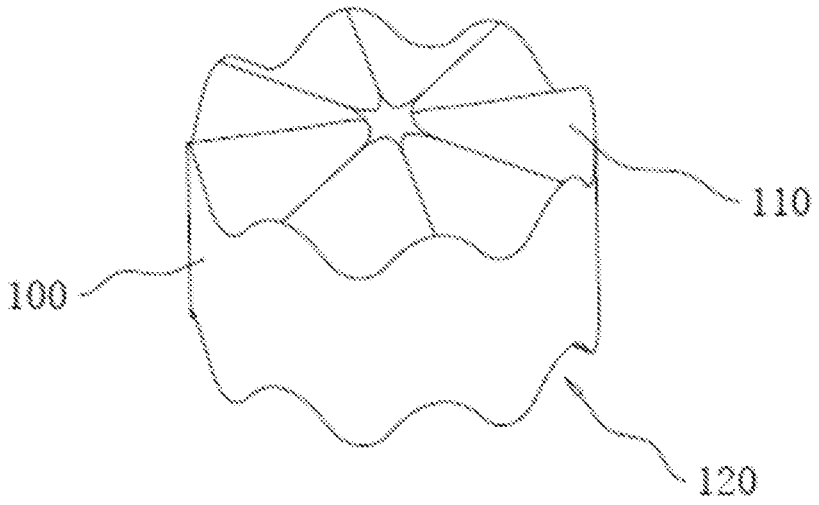
FIG. 9 is a schematic structure diagram of a basic connecting block according to an embodiment 7 of the present application.

Referring to FIG. 9, a basic connecting block includes a connecting block body 100, which is cylindrical. The connecting block body 100 is provided with a plurality of protrusion corners 110 on one end thereof and a plurality of inward recesses 120 on another end thereof, which one-to-one correspond to the protrusion corners 110. The surface contours of the protrusion corners 110 are coincident with that of the inward recess 120 and the protrusion corners 110 are circular arch. A projection of the protrusion corner 110 on the connecting block body 100 completely coincides with a projection of a corresponding inward recess 120 on the connecting block body 100. The plurality of protrusion corners 110 are rotationally symmetrically arranged about the central axis of the connecting block body 100 and the plurality of inward recesses 120 are rotationally symmetrically arranged about the central axis of the connecting block body 100 as well. In this embodiment, there are eight protrusion corners 110 and correspondingly eight inward recesses 120. The plurality of protrusion corners 110 are connected with each and the plurality of inward recesses 120 are communicated with each other. The protrusion corners 110 are circular arch.

The implementation principle of embodiment 7 will be described below. When connecting a plurality of basic connecting blocks, a protrusion corner 110 of a connecting block body 100 is placed correspondingly in an inward recess 120 of an adjacent connecting block body 100 in the up-and-down direction. When the upper and lower adjacent basic connecting blocks are abutted and stacked up, the protrusion corner 110 of the lower basic connecting block is placed in the inward recess 120 of the upper basic connecting block, so that the upper basic connecting block can be stably placed on the lower basic connecting block. After the upper basic connecting block rotates by a certain angle, it can still be stably placed on the lower basic connecting block, which can improve the interestingness when the basic connecting blocks are used as block toys.

Embodiment 8

Figure 10:
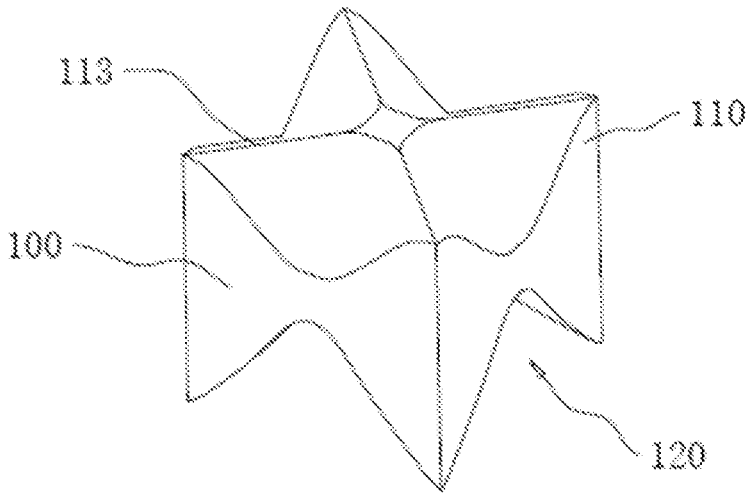
FIG. 10 is a schematic structure diagram of a basic connecting block according to an embodiment 8 of the present application, which illustrates a position structure of a protrusion corner and a first arris edge.
Figure 11:
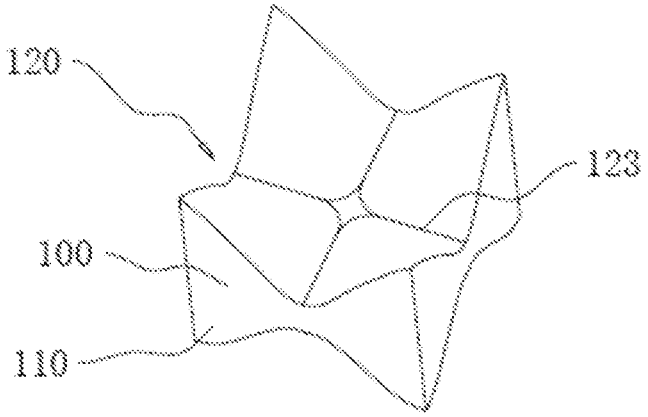
FIG. 11 is a schematic structure diagram of the basic connecting block according to the embodiment 8 of the present application, which illustrates a position structure of an inward recess and a second arris edge.

Referring to FIGS. 10 and 11, a basic connecting block includes a connecting block body 100 with equal length and width. That is, the connecting block body 100 is square in the top view. The connecting block body 100 is provided with four protrusion corners 110 on one side thereof and four inward recesses 120 on another side thereof. The protrusion corners 110 and the inward recesses 120 are provided in two opposite sides of the connecting block body 100 respectively, i.e., the upper and lower surfaces in FIG. 10. The four protrusion corners 110 are rotationally symmetrically arranged about the central axis of the connecting block body 100, and the four inward recesses 120 are rotationally symmetrically arranged about the central axis of the connecting block body 100 as well. The four protrusion corners 110 are connected with each and the four inward recesses 120 are communicated with each other. The outer contour of the protrusion corner 110 is a sine curve. The protrusion corner 110 has a first arris edge 113 away from the connecting block body 100, which is at the vertex of the sine curve. The connecting block body 100 has a second arris edge 123 in the inward recess 120, which is at the vertex of the sinusoidal contour of the inward recess 120. Projections of the first arris edge 113 and the second arris edge 123 are intersected on the horizonal plane with an included angle of 45 degrees.

Figure 12:
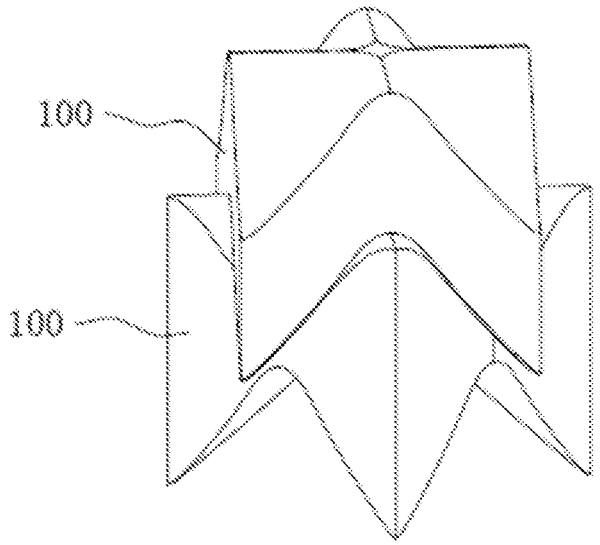
FIG. 12 is a schematic structure diagram of the stacked basic connecting blocks according to the embodiments 2 and 8 of the present application.

Referring to FIG. 12, since the included angle of projections of the first arris edge 113 and the second arris edge 123 on the horizonal plane is 45 degrees, when stacking up a plurality of the basic connecting blocks, FIG. 11 shows stacking of a basic connecting block according to this embodiment with a basic connecting block according to the embodiment 2, in which the upper and lower basic connecting blocks are staggered and stacked in a certain angle. Because the contour of the protrusion corner 110 is a sine curve, a basic connecting blocks according to this embodiment can contact with a basic connecting blocks according to the embodiment 2 with a larger area, such that the stacking structure is more stable.

Embodiment 9

Figure 13:
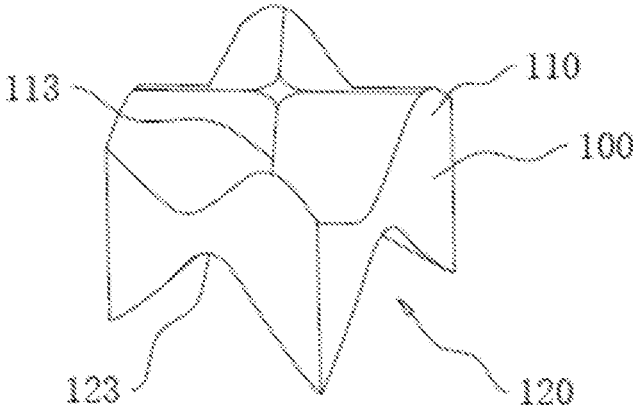
FIG. 13 is a schematic structure diagram of a basic connecting block according to an embodiment 9 of the present application.

Referring to FIG. 13, this embodiment differs from the embodiment 8 in that, projections of the first arris edge 113 and the second arris edge 123 on the horizonal plane are intersected with an included angle of 30 degrees.

The included angle of the first arris edge 113 and the second arris edge 123 on the horizonal plane can be set to different angles in a range of 0-90 degrees, so that the upper and lower basic connecting blocks can be staggered and stacked in different angles, which can improve the interestingness when the basic connecting blocks are used as block toys.

The present application also provides a connecting block group.

Embodiment 10

Figure 14:
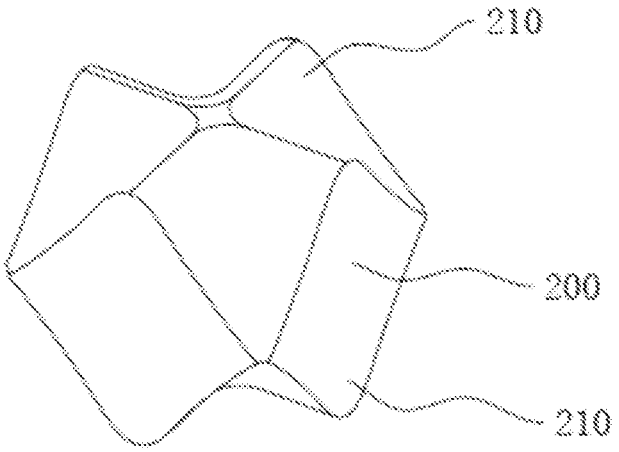
FIG. 14 is a schematic structure diagram of an expansion connecting block according to an embodiment 10 of the present application.

Referring to FIG. 14, a connecting block group includes an expansion connecting block 200 with an equal length and width. That is, the expansion connecting block 200 is square in the top view. The expansion connecting block 200 is provided with at least one expansion protrusion corner 210 on each of two opposite sides thereof. In this embodiment, there are four expansion protrusion corners 210 and the contour of an expansion protrusion corner 210 is sinusoidal in the side view. The contour of an expansion protrusion corner 210 is consistent with the contour of the inward recess 120 according to the embodiment 2. The four expansion protrusion corners 210 are connected with each other and are rotationally symmetrically arranged about the central axis of the expansion connecting block 200. The connecting block group also includes a basic connecting block according to any of the embodiments 2-5 and 8-9.

The expansion connecting block in this embodiment can be used together with the basic connecting block in the embodiments 2-5 and 8-9, which can improve the interestingness when the basic connecting blocks are used as block toys.

Embodiment 11

Figure 15:
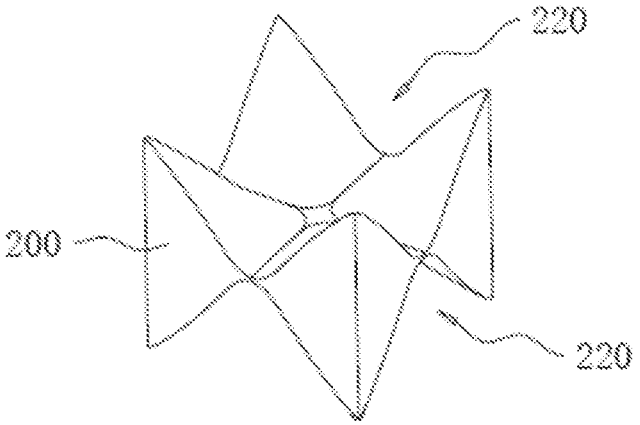
FIG. 15 is a schematic structure diagram of an expansion connecting block according to an embodiment 11 of the present application.

Referring to FIG. 15, a connecting block group includes an expansion connecting block 200 with an equal length and width. That is, the expansion connecting block 200 is square in the top view. The expansion connecting block 200 is provided with at least one expansion inward recess 220 on each of two opposite sides thereof. In this embodiment, there are four expansion inward recesses 220, and the contour of the expansion inward recess 220 is consistent with the contour of the protrusion corner 110 according to the embodiment 2. The four expansion inward recesses 220 are communicated with each other and are rotationally symmetrically arranged about the central axis of the expansion connecting block 200.

The expansion connecting block in this embodiment can be used together with the basic connecting blocks in the embodiments 2-5 and 8-9, which can improve the interestingness when the basic connecting blocks are used as block toys.

The above are the preferred embodiments of the present application, which are not intended to limit the protection scope of the present application. Therefore, all equivalent changes made according to the structure, shape and principle of the present application should fall within the protection scope of the present application.

List of reference signs: 100, connecting block body; 110, protrusion corner; 111, first transition surface; 112, outer plane; 113, first arris edge; 120, inward recess; 121, second transition surface; 122, inner plane; 123, second arris edge; 200, expansion connecting block; 210, expansion protrusion corner; 220, expansion inward recess.

What is claimed is:

1. A basic connecting block, comprising: a connecting block body, wherein a plurality of protrusion corners are provided on one side of the connecting block body and a same number of inward recesses as the plurality of protrusion corners are provided on an opposite side of the connecting block body, and wherein a surface contour of the plurality of protrusion corners is consistent with that of the plurality of inward recesses, the plurality of protrusion corners are connected with each other and the plurality of inward recesses are communicated with each other;

the plurality of protrusion corners are rotationally symmetrically arranged about a central axis of the connecting block body, and the plurality of inward recesses are rotationally symmetrically arranged about the central axis of the connecting block body;

each of the plurality of protrusion corners is provided with a first arris edge that is located at a position where a distance from each of the plurality of protrusion corners to the connecting block body is farthest, the connecting block body is provided with a second arris edge in each of the plurality of inward recesses that is located at a position where a distance from each of the plurality of inward recesses to a surface of the connecting block body provided with the plurality of inward recesses is farthest, and projections of the first arris edge and the second arris edge are intersected on a side of the connecting block body provided with the plurality of protrusion corners.

2. The basic connecting block according to claim 1, wherein a first transition surface is provided between adjacent protrusion corners, and a second transition surface is provided between adjacent inward recesses.

3. The basic connecting block according to claim 1, wherein an outer plane is provided at a junction of the plurality of protrusion corners, and an inner plane is provided at a junction of the plurality of inward recesses, and wherein shape of the inner plane is the same as the outer plane.

4. The basic connecting block according to claim 1, wherein the basic connecting block comprises a plurality of the connecting block bodies that are fixedly connected with each other, and side surfaces of the connecting block bodies provided with the plurality of protrusion corners are coplanar.

5. The basic connecting block according to claim 4, wherein the plurality of connecting block bodies have the same volume and different densities.

6. The basic connecting block according to claim 1, wherein the basic connecting block is used as a block toy.

7. The basic connecting block according to claim 1, wherein the basic connecting block is applied in an architecture field.

8. A connecting block group, comprising: the basic connecting block according to claim 1 and an expansion connecting block, wherein the expansion connecting block is provided with at least one expansion protrusion corner on each of two opposite sides thereof, and the at least one expansion protrusion corner is interconnected with each other.

9. A connecting block group, comprising: the basic connecting block according to claim 1 and an expansion connecting block, wherein the expansion connecting block is provided with at least one expansion inward recess on each of two opposite sides thereof, and the at least one expansion inward recess is communicated with each other.

* * * * *